US009666131B2

(12) United States Patent
Chen

(10) Patent No.: US 9,666,131 B2
(45) Date of Patent: May 30, 2017

(54) PIXEL CIRCUIT AND DISPLAY

(71) Applicants: BOE TECHNOLOGY GROUP CO., LTD., Beijing (CN); ORDOS YUANSHENG OPTOELECTRONICS CO., LTD., Ordos, Inner Mongolia (CN)

(72) Inventor: Junsheng Chen, Beijing (CN)

(73) Assignees: BOE TECHNOLOGY GROUP CO., LTD., Beijing (CN); ORDOS YUANSHENG OPTOELECTRONICS CO., LTD., Ordos, Inner Mongolia (CN)

( * ) Notice: Subject to any disclaimer, the term of this patent is extended or adjusted under 35 U.S.C. 154(b) by 239 days.

(21) Appl. No.: 14/368,633

(22) PCT Filed: Dec. 10, 2013

(86) PCT No.: PCT/CN2013/089018

§ 371 (c)(1),
(2) Date: Jun. 25, 2014

(87) PCT Pub. No.: WO2015/032141

PCT Pub. Date: Mar. 12, 2015

(65) Prior Publication Data

US 2016/0155383 A1 Jun. 2, 2016

(30) Foreign Application Priority Data

Sep. 6, 2013 (CN) ..... 2013 1 0404123

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0443* (2013.01);
(Continued)

(58) Field of Classification Search
CPC ..... G09G 3/3233; G09G 2300/0861; G09G 2310/06
See application file for complete search history.

(56) References Cited

U.S. PATENT DOCUMENTS 6,501,466 B1 * 12/2002 Yamagishi ..... G09G 3/3241 345/204
2003/0107560 A1 * 6/2003 Yumoto ..... G09G 3/30 345/204

(Continued)

FOREIGN PATENT DOCUMENTS

CN 203480808 U 3/2014

OTHER PUBLICATIONS

Written Opinion of the International Searching Authority dated Apr. 21, 2014; PCT/CN2013/089018.

(Continued)

*Primary Examiner* — Kent Chang
*Assistant Examiner* — Sujit Shah
(74) *Attorney, Agent, or Firm* — Ladas & Parry LLP

(57) ABSTRACT

The pixel circuit includes a first pixel sub-circuit , a second pixel sub-circuit, an initialization module and a data voltage writing module connected to the first pixel sub-circuit and the second pixel sub-circuit; the initialization module is connected to the reset signal terminal and the low potential terminal; the data voltage writing module is connected to a data voltage and a gate signal terminal, and is configured to firstly write a first data voltage to the first pixel sub-circuit and the second pixel sub-circuit and compensate for a driving module of the first pixel sub-circuit, and then to write a second data voltage to the second pixel sub-circuit and compensate for a driving module of the second pixel sub-circuit.

19 Claims, 9 Drawing Sheets

(52) U.S. Cl.
CPC ..... *G09G 2300/0465* (2013.01); *G09G 2300/0819* (2013.01); *G09G 2300/0842* (2013.01); *G09G 2300/0852* (2013.01); *G09G 2300/0861* (2013.01); *G09G 2310/0256* (2013.01); *G09G 2320/0238* (2013.01)

(56) References Cited

U.S. PATENT DOCUMENTS

| | | | | |
|---|---|---|---|---|
| 2006/0214596 | A1* | 9/2006 | Miller | G09G 3/3233 315/169.3 |
| 2010/0328198 | A1* | 12/2010 | Tsubata | G09G 3/3659 345/87 |
| 2011/0121738 | A1 | 5/2011 | Kawano et al. | |
| 2012/0062135 | A1* | 3/2012 | Tamaki | H05B 33/08 315/210 |
| 2012/0147060 | A1* | 6/2012 | Jeong | G09G 3/3233 345/690 |
| 2012/0169679 | A1* | 7/2012 | Lin | G02F 1/13624 345/204 |
| 2013/0141412 | A1* | 6/2013 | Kang | G09G 3/3233 345/212 |
| 2013/0257839 | A1* | 10/2013 | Hyeon | G06F 3/038 345/212 |

OTHER PUBLICATIONS

International Search Report dated Mar. 28, 2014; PCT/CN2013/089018.

* cited by examiner

PIXEL CIRCUIT AND DISPLAY

TECHNICAL FIELD

The present invention relates to a field of display technology, and more particularly, to a pixel circuit and a display.

BACKGROUND

Backboard of the existing high-end active matrix organic light emitting diode (AMOLED) product with medium or small size mostly employs a process technology of low temperature poly-silicon (LTPS); however, since fluctuation of LTPS process will lead to drift of the threshold voltage of a thin film transistor (TFT) device, rendering current for driving organic light emitting diode (OLED) device unstable, thus resulting in a decrease in the display quality of pictures. Pixel compensation circuit as known is a circuit of 6T1C type (a circuit formed by six thin film transistors and one capacitor), and the circuit diagram is shown in FIG. 1, where VDD is a high voltage level signal, VSS is a low voltage level signal, Data is a data signal, Gate is a gate control signal, Reset is an initialization control signal, Vinit is an initialization voltage level signal, Emission (that is EM) is a signal for controlling light emission of OLED and this voltage is provided by the emission circuit of the OLED panel. However, it is not easy to dispose six thin film transistors and one capacitor in one pixel, and since it needs the TFT devices to be made very small, and thus requirement for performance of the TFT devices is also relatively high, causing pixel pitch to be unable to be further decreased.

As shown in FIG. 2, for the 6T1C circuit as known, devices which needs to be disposed on horizon direction of two pixels includes two data signal lines of Data v1 and Data v2, twelve TFTs, two capacitors, one gate control signal line Gate, one light emission control signal terminal Emission, one high voltage level signal terminal VDD, one initialization voltage level signal terminal Vinit, one initialization control signal terminal Reset; in FIG. 2, there are two organic light-emitting diodes, OLED 1 and OLED 2, and each of the cathodes thereof is connected to a low voltage level signal VSS; FIG. 2 is a circuit schematic diagram of two pixels arranged in horizon, and they forms one pixel unit on horizon or vertical direction; the devices that needs to be disposed on vertical direction includes one data signal line, twelve TFTs, two capacitors, two gate control signal lines, one light emission control signal terminal Emission, one high voltage level signal terminal VDD and one initialization voltage level signal terminal Vinit.

As described above, it is known that there needs to dispose 12 TFTs and two capacitors in two pixels.

SUMMARY

Embodiments of the present invention provide a pixel circuit for reducing a size of pixel circuit, so as to further reduce pixel pitch, increase the number of the pixels contained in per unit area and improve image display quality. An embodiment of the present invention further provides a display.

A pixel circuit provided in accordance with to an embodiment of the present invention comprises a first pixel sub-circuit and a second pixel sub-circuit, as well as an initialization module and a data voltage writing module connected to the first pixel sub-circuit and the second pixel sub-circuit, wherein the initialization module is connected to a reset signal terminal and a low potential terminal, and serves to initialize the first pixel sub-circuit and the second pixel sub-circuit under control of a reset signal inputted from the reset signal terminal;

the data voltage writing module is connected to a data voltage and a gate signal terminal, and serves to firstly write a first data voltage to the first pixel sub-circuit and the second pixel sub-circuit under control of a signal inputted from the gate signal terminal and compensate for a driving module of the first pixel sub-circuit, and then to write a second data voltage to the second pixel sub-circuit and compensate for a driving module of the second pixel sub-circuit.

The pixel circuit provided in accordance with an embodiment of the present invention comprises the first pixel sub-circuit and the second pixel sub-circuit, as well as the initialization module and the data voltage writing module connected to the first pixel sub-circuit and the second pixel sub-circuit; the pixel circuit formed by the first pixel sub-circuit, the second pixel sub-circuit, the initialization module and the data voltage writing module can reduce size of the pixel circuit, so as to further reduce pixel pitch, increase the number of the pixels contained in per unit area and improve image display quality.

Optionally, the first pixel sub-circuit comprises a first driving module, a first light emission module, a first threshold compensation module and a first light emission control module, wherein the initialization module is connected to the first threshold compensation module, and serves to initialize the first threshold compensation module under control of an initialization signal outputted from the initialization module;

the first threshold compensation module is connected to the first driving module, and serves to perform threshold voltage compensation on the first driving module; and the first light emission module is connected to the first light emission control module, and serves to emit light for display with operation of the first light emission control module.

In this way, the first pixel sub-circuit formed by the first driving module, the first light emission module, the first threshold compensation module and the first light emission control module is easy to be implemented in design of the pixel circuit.

Optionally, the first threshold compensation module comprises a first storage capacitor, a third transistor and a fifth transistor; the first driving module comprises a fourth transistor; the first light emission control module comprises a sixth transistor and a seventh transistor; and the first light emission module comprises a first light-emitting diode.

In this way, the first pixel sub-circuit formed by the storage capacitor, the transistors and the light-emitting diode is easy to be implemented in design of the pixel circuit.

Optionally, one terminal of the first storage capacitor is connected to a high voltage level signal line, and the other terminal thereof is connected to the source of the third transistor;

the gate of the third transistor is connected to a gate signal terminal, and the drain of third transistor is connected to the drain of the fourth transistor;

the gate of the fifth transistor is connected to a switching control signal line, the source of the fifth transistor is connected to the drain of the sixth transistor, and the drain of the fifth transistor is connected to the source of the fourth transistor;

the gate of the fourth transistor is connected to the initialization module;

the gate of the sixth transistor is connected to the light emission control signal line, and the source of the sixth transistor is connected to the high voltage level signal line;

the gate of the seventh transistor is connected to the light emission control signal line, the source of the seventh transistor is connected to the drain of the fourth transistor, and the drain of the seventh transistor is connected the first light-emitting diode; and the anode of the first light-emitting diode is connected is the drain of the seventh transistor, and the cathode of the first light-emitting diode is connected to a low voltage level signal line.

In this way, the connection relationship of the storage capacitor, the transistors and the light-emitting diode is easy to be implemented in design of the pixel circuit.

Optionally, the second pixel sub-circuit comprises a second driving module, a second light emission module, a second threshold compensation module and a second light emission control module, wherein the initialization module is connected to the second threshold compensation module, and serves to initialize the second threshold compensation module under control of an initialization signal outputted from the initialization module;

the second threshold compensation module is connected to the second driving module, and serves to perform threshold voltage compensation on the second driving module;

and the second light emission module is connected to the second light emission control module, and serves to emit light for display with operation of the second light emission control module.

In this way, the second pixel sub-circuit formed by the second driving module, the second light emission module, the second threshold compensation module and the second light emission control module is easy to be implemented in design of the pixel circuit.

Optionally, the second threshold compensation module comprises a second storage capacitor and a tenth transistor; the second driving module comprises a ninth transistor; the second light emission control module comprises a sixth transistor and an eighth transistor; and the second light emission module comprises a second light-emitting diode.

In this way, the second pixel sub-circuit formed by the storage capacitor, the transistors and the light-emitting diode is easy to be implemented in design of the pixel circuit.

Optionally, one terminal of the second storage capacitor is connected to the high voltage level signal line, and the other terminal thereof is connected to the source of the tenth transistor;

the gate of the tenth transistor is connected to the gate signal terminal, and the drain of the tenth transistor is connected to the drain of the ninth transistor;

the gate of the ninth transistor is connected to the source of the tenth transistor, and the source of the ninth transistor is connected to the data voltage writing module;

the gate of the sixth transistor is connected to the light emission control signal line, and the source of the sixth transistor is connected to the high voltage level signal line, and the drain of the sixth transistor is connected to the source of the ninth transistor;

the gate of the eighth transistor is connected to the light emission control signal line, and the source of the eighth transistor is connected to the drain of the ninth transistor, and the drain of the eighth transistor is connected to the second light-emitting diode;

and the anode of the second light-emitting diode is connected to the drain of the eighth transistor, and the cathode of the second light-emitting diode is connected to the low voltage level signal line.

In this way, the connection relationship of the storage capacitor, the transistors and the light-emitting diode is easy to be implemented in design of the pixel circuit.

Optionally, the initialization module comprises a first transistor and an eleventh transistor, wherein the gate of the first transistor is connected to a reset signal line, the drain of the first transistor is connected to the first threshold compensation module of the first pixel sub-circuit, and the source of the first transistor is connected to a low potential terminal; the gate of the eleventh transistor is connected to the reset signal line, the drain of the eleventh transistor is connected to the second threshold compensation module of the second pixel sub-circuit, and the source of the eleventh transistor is connected to the low potential terminal.

In this way, the initialization module comprises the first transistor and the eleventh transistor, and the first and the eleventh transistors function as the switching devices of the initialization module in the pixel circuit and are easy to be implemented in the circuit design.

Optionally, the data voltage writing module comprises a second transistor, wherein the gate of the second transistor is connected to the gate signal terminal, the source of the second transistor is connected to a data signal line, and the drain of the second transistor is connected to the first threshold compensation module of the first pixel sub-circuit and the second driving module of the second pixel sub-circuit.

In this way, the data voltage writing module comprises the second transistor, and the second transistor functions as the switching device of the data voltage writing module in the pixel circuit and is easy to be implemented in the circuit design.

Optionally, the data voltage written by the data voltage writing module comprises a first data voltage and a second data voltage, wherein the first data voltage serves to drive the first threshold compensation module to perform the threshold voltage compensation on the first driving module, and the second data voltage serves to drive the second threshold compensation module to perform the threshold voltage compensation on the second driving module.

In this way, since the data signal is a timing signal of a stepped shape, it is possible to realize two different voltage values inputted by one data signal line.

Optionally, each of the first light-emitting diode and the second light-emitting diode is an organic light-emitting diode.

In this way, the organic light-emitting diode is used as the light-emitting diode of the first light emission module and the second light emission module in the pixel circuit, and it is easy to be implemented in the circuit design.

Optionally, each of the transistors is a thin film transistor of P type.

In this way, the thin film transistor of P type is used as the thin film transistor in the pixel circuit, and it is easy to be implemented in the circuit design.

A display provided by an embodiment of the present invention comprises a plurality of pixels, data signal lines and gate control signal lines, wherein each two of the pixels constitute a pixel unit, and the display further comprises the pixel circuit described above which is connected to respective one of pixel units.

In this way, since the display comprises the pixel circuit described above which is connected to respective one of pixel units, the display possesses the advantage of the pixel circuit, and the display quality of the picture can be greatly improved.

Optionally, two pixels in each of the pixel units share one data signal line.

In this way, two pixels in each of the pixel units share one data signal line, thus one data signal line can be saved by the two pixels, and the arrangement of the data signal lines is simple.

Optionally, two pixels in each of the pixel units share one gate control signal line.

In this way, two pixels in each of the pixel units share one gate control signal line, thus one gate control signal line can be saved by the two pixels, and the arrangement of the gate control signal lines is simple.

DETAILED DESCRIPTION

Embodiments of the present invention provide a pixel circuit and a display for reducing size of a pixel circuit, so as to further reduce pixel pitch, increase the number of the pixels contained in per unit area and improve image display quality.

Here, the pixel circuit provided by embodiments of the present invention refers to an active matrix light emitting diode pixel circuit, and since the active matrix light emitting diode pixel circuit can play a role of performing compensation on a driving module of the pixel, the active matrix light emitting diode pixel circuit of the present invention can also be referred to as active matrix light emitting diode pixel compensation circuit.

Hereinafter, detailed discussion will be given to a technical solution provided by the embodiments of the present invention.

Figure 1:
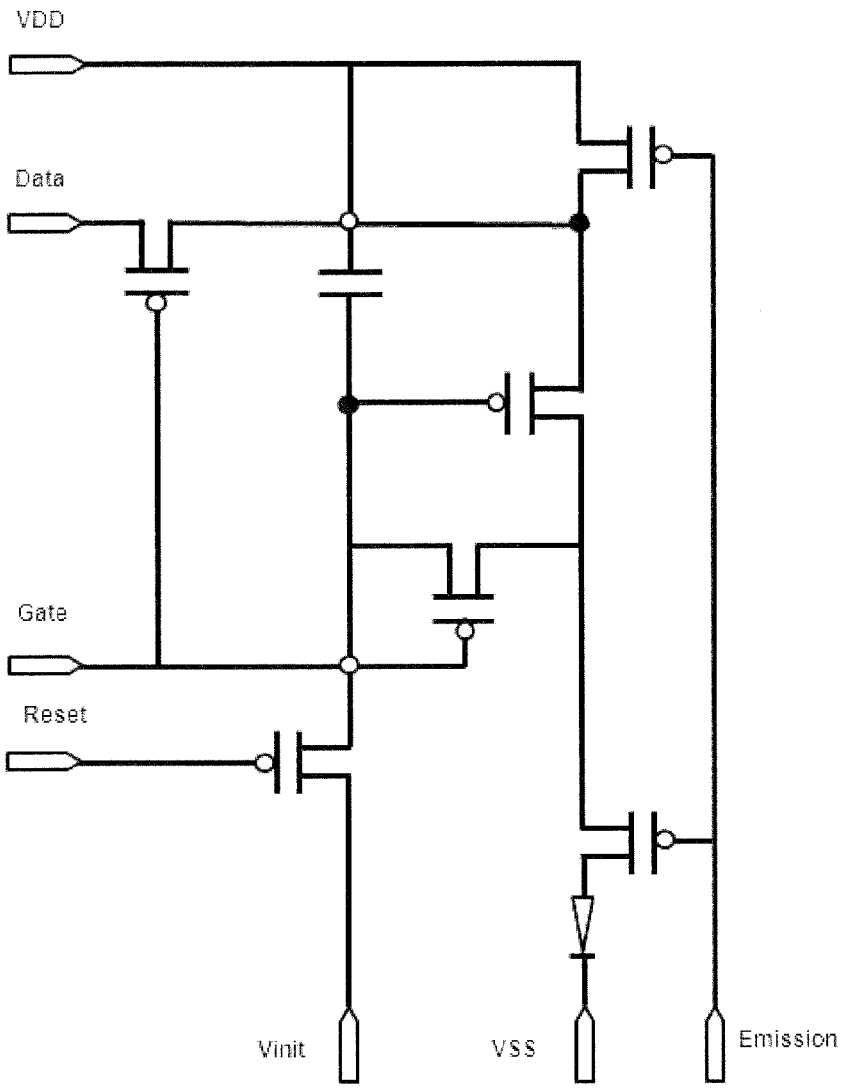
FIG. 1 is a schematic diagram of a 6T1C AMOLED pixel compensation circuit of a single pixel as known.
Figure 2:
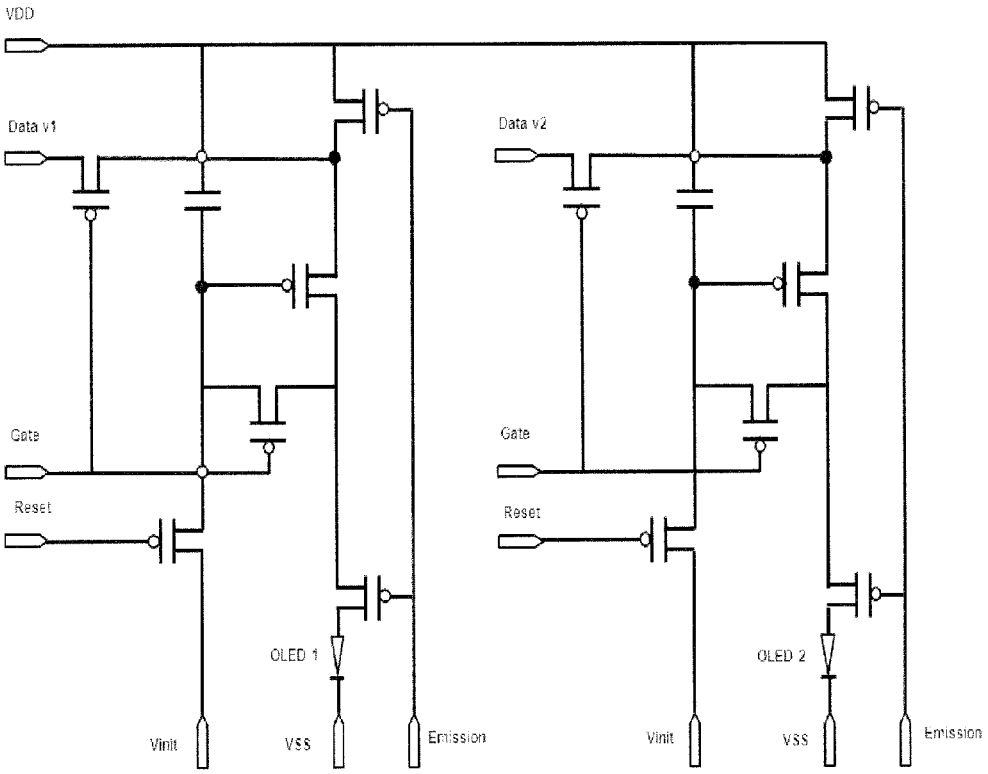
FIG. 2 is a schematic diagram of a 12T2C AMOLED pixel compensation circuit of two pixel as known.
Figure 3:
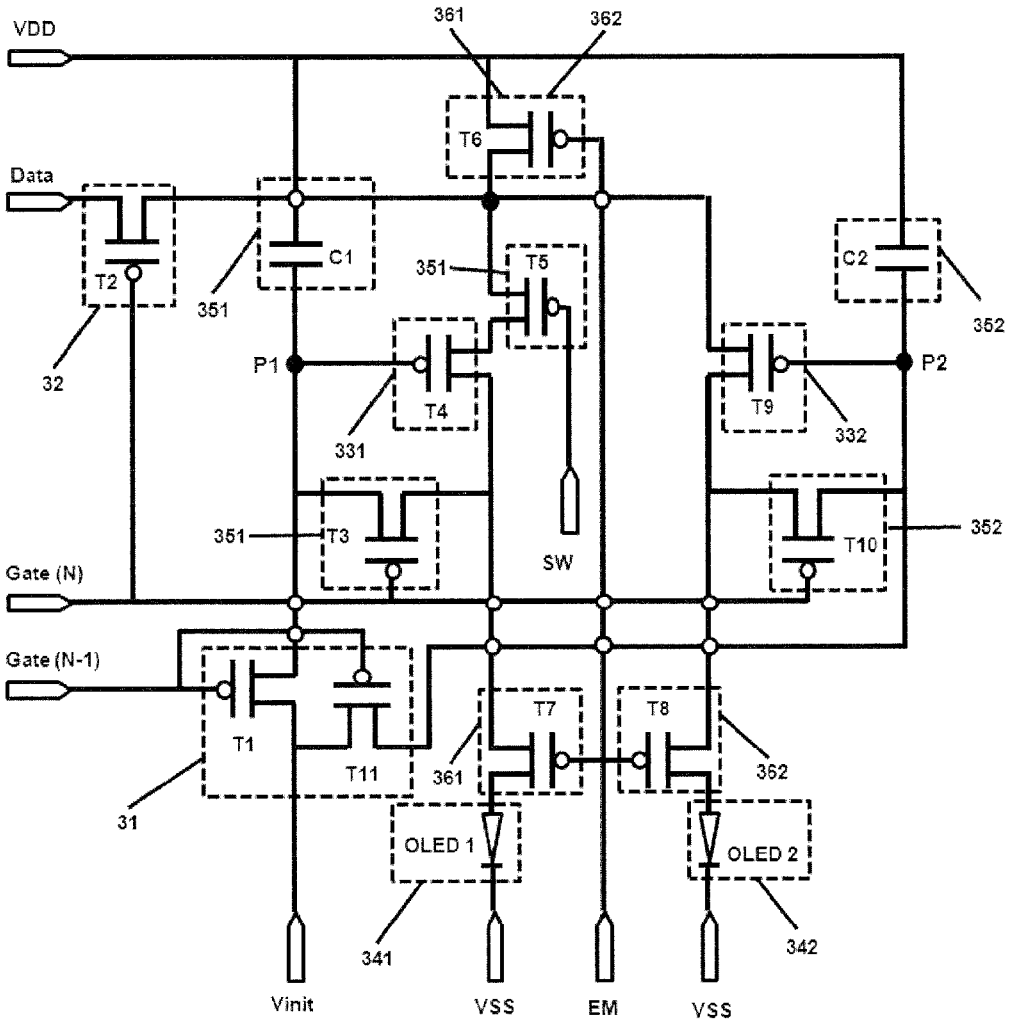
FIG. 3 is a schematic diagram of a 11T2C AMOLED pixel circuit provided by an embodiment of the present invention.

As shown in FIG. 3, an active matrix light emitting diode pixel compensation circuit provided in an embodiment of the disclosure comprises a first pixel sub-circuit and a second pixel sub-circuit, as well as an initialization module 31 and a data voltage writing module 32 connected to the first pixel sub-circuit and the second pixel sub-circuit.

The initialization module 31 is connected to a reset signal terminal (corresponding to a gate control signal Gate(N−1) at the previous stage of the AMOLED pixel circuit) and a low potential terminal (corresponding to initialization voltage level signal Vinit of the AMOLED pixel circuit), and serves to initialize the first pixel sub-circuit and the second pixel sub-circuit under control of a reset signal inputted from the reset signal terminal.

The data voltage writing module 32 is connected to a data signal line (corresponding to data signal Data of the AMOLED pixel circuit) and a gate signal terminal (corresponding to the gate control signal Gate(N) at the present stage of the AMOLED pixel compensation circuit), and serves to firstly write a first data voltage to the first pixel sub-circuit and the second pixel sub-circuit under control of a signal inputted from the gate signal terminal and compensate for a driving module of the first pixel sub-circuit, and then to write a second data voltage to the second pixel sub-circuit and compensate for a driving module of the second pixel sub-circuit.

In the circuit shown in FIG. 3, in order to distinguish cross connection and disconnection between wires, the connected cross point is represented with a solid dot, and the disconnected cross point is represented with a hollow dot.

Optionally, the first pixel sub-circuit comprises a first driving module 331, a first light emission module 341, a first threshold compensation module 351 and a first light emission control module 361; the initialization module 31 is connected to the first threshold compensation module 351, and serves to initialize the first threshold compensation module 351 under control of an initialization signal outputted from the initialization module 31; the first threshold compensation module 351 is connected to the first driving module 331, and serves to perform threshold voltage compensation on the first driving module 331; the first light emission module 341 is connected to the first light emission control module 361, and serves to emit light for display with operation of the first light emission control module 361.

Optionally, the first threshold compensation module 351 comprises a first storage capacitor C1, a third transistor T3 and a fifth transistor T5; the first driving module 331 comprises a fourth transistor T4; the first light emission control module 361 comprises a sixth transistor T6 and a seventh transistor T7; and the first light emission module 341 comprises a first light-emitting diode OLED1.

Optionally, one terminal of the first storage capacitor C1 is connected to a high voltage level signal line (corresponding to a high voltage level signal VDD), and the other terminal thereof is connected to the source of the third transistor T3; the gate of the third transistor T3 is connected to a gate signal terminal (corresponding to the gate control signal Gate(N) at the present stage of the AMOLED pixel compensation circuit), and the drain of third transistor T3 is connected to the drain of the fourth transistor T4; the gate of the fifth transistor T5 is connected to a switching control signal line (corresponding to the switching control signal SW of the AMOLED pixel compensation circuit), the source of the fifth transistor T5 is connected to the drain of the sixth transistor T6, and the drain of the fifth transistor T5 is connected to the source of the fourth transistor T4; the gate of the fourth transistor T4 is connected to the initialization module 31; the gate of the sixth transistor T6 is connected to the light emission control signal line (corresponding to the light emission control signal EM of the AMOLED pixel circuit), and the source of the sixth transistor T6 is connected to a high voltage level signal line (corresponding to the high voltage level signal VDD); the gate of the seventh transistor T7 is connected to the light emission control signal line (corresponding to the light emission control signal EM of the AMOLED pixel circuit), the source of the seventh transistor T7 is connected to the drain of the fourth transistor T4, and the drain of the seventh transistor T7 is connected to the first light-emitting diode OLED1; and the anode of the first light-emitting diode OLED 1 is connected to the drain of the seventh transistor T7, and the cathode of the first light-emitting diode OLED1 is connected to the low voltage level signal line (corresponding to a low voltage level signal VSS).

Optionally, the second pixel sub-circuit comprises a second driving module 332, a second light emission module 342, a second threshold compensation module 352 and a second light emission control module 362; the initialization module 31 is connected to the second threshold compensation module 352, and serves to initialize the second threshold compensation module 352 under control of an initialization signal outputted from the initialization module 31; the second threshold compensation module 352 is connected to the second driving module 332, and serves to perform threshold voltage compensation on the second driving module 332; and the second light emission module 342 is connected to the second light emission control module 362, and serves to emit light for display with operation of second light emission control module 362.

Optionally, the second threshold compensation module 352 comprises a second storage capacitor C2 and a tenth transistor T10; the second driving module 332 comprises a ninth transistor T9; the second light emission control module 362 comprises a sixth transistor T6 and an eighth transistor T8; and the second light emission module 342 comprises a second light-emitting diode OLED2.

Optionally, one terminal of the second storage capacitor C2 is connected to the high voltage level signal line (corresponding to the high voltage level signal VDD), and the other terminal thereof is connected to the source of the tenth transistor T10; the gate of the tenth transistor T10 is connected to the gate signal terminal(corresponding to the gate control signal Gate (N)) at the present stage of the AMOLED pixel compensation circuit), and the drain of the tenth transistor T10 is connected to the drain of the ninth transistor T9; the gate of the ninth transistor T9 is connected to the source of the tenth transistor T10, and the source of the ninth transistor T9 is connected to the data voltage writing module 32; the gate of the sixth transistor T6 is connected to the light emission control signal line (corresponding to the light emission control signal EM of the AMOLED pixel circuit), and the source of the sixth transistor T6 is connected to the high voltage level signal line (corresponding to the high voltage level signal VDD), and the drain of the sixth transistor T6 is connected to the source of the ninth transistor T9; the gate of the eighth transistor T8 is connected to the light emission control signal line (corresponding to the light emission control signal EM of the AMOLED pixel circuit), and the source of the eighth transistor T8 is connected to the drain of the ninth transistor T9, and the drain of the eighth transistor T8 is connected to the second light-emitting diode OLED2; the anode of the second light-emitting diode OLED2 is connected to the drain of the eighth transistor T8, and the cathode of the second light-emitting diode OLED2 is connected to the low voltage level signal line (corresponding to the low voltage level signal VSS).

Here, the sixth transistor T6 is a switching transistor common to the first light emission control module 361 and the second light emission control module 362, and the light emitting control modules 361 and 362 can control the light emission of the OLED 1 and the OLED 2 simultaneously or separately.

Optionally, the initialization module 31 comprises a first transistor T1 and an eleventh transistor T11, wherein the gate of the first transistor T1 is connected to a reset signal line (corresponding to the gate control signal Gate(N−1) at the previous stage of the AMOLED pixel circuit), the drain of the first transistor T1 is connected to a first threshold compensation module 351 of the first pixel sub-circuit, and the source of the first transistor T1 is connected to the low potential terminal (corresponding to the initialization voltage level signal Vinit of the AMOLED pixel circuit); the gate of the eleventh transistor T11 is connected to the reset signal line (corresponding to the gate control signal Gate (N−1) at the previous stage of the AMOLED pixel circuit), the drain of the eleventh transistor T11 is connected to the second threshold compensation module 352 of the second pixel sub-circuit, and the source of the eleventh transistor T11 is connected to the low potential terminal (corresponding to the initialization voltage level signal Vinit of the AMOLED pixel circuit).

Optionally, the data voltage writing module 32 comprises a second transistor T2, wherein the gate of the second transistor T2 is connected to the gate signal terminal (corresponding to the gate control signal Gate(N) at the present stage of the AMOLED pixel compensation circuit), the source of the second transistor T2 is connected to a data signal line (corresponding to the data signal Data of the AMOLED pixel circuit), and the drain of the second transistor T2 is connected to the source of the fifth transistor T5 and the second driving module 332 of the second pixel sub-circuit.

Here, value of N in the gate control signal Gate(N) at the present stage and the gate control signal Gate(N−1) at the previous stage can be chosen in accordance with the number of the gate control signal lines in the pixel compensation circuit or as necessary.

Optionally, data voltage inputted to the data voltage writing module 32 comprises a first data voltage and a second data voltage, wherein the first data voltage serves to drive the first threshold compensation module 351 to perform threshold voltage compensation on the first driving module 331, and the second data voltage serves to drive the second threshold compensation module 352 to perform threshold voltage compensation on the second driving module 332.

Optionally, each of the first light-emitting diode OLED1 and the second light-emitting diode OLED2 is an organic light emitting diode.

Optionally, each of the transistors T1, T2, T3, T4, T5, T6, T7, T8, T9, T10 and T11 is a thin film transistor of P type.

Hereinafter, the operational principle of the AMOLED pixel compensation circuit provided by an embodiment of the present invention will be explained in details.

Figure 4:
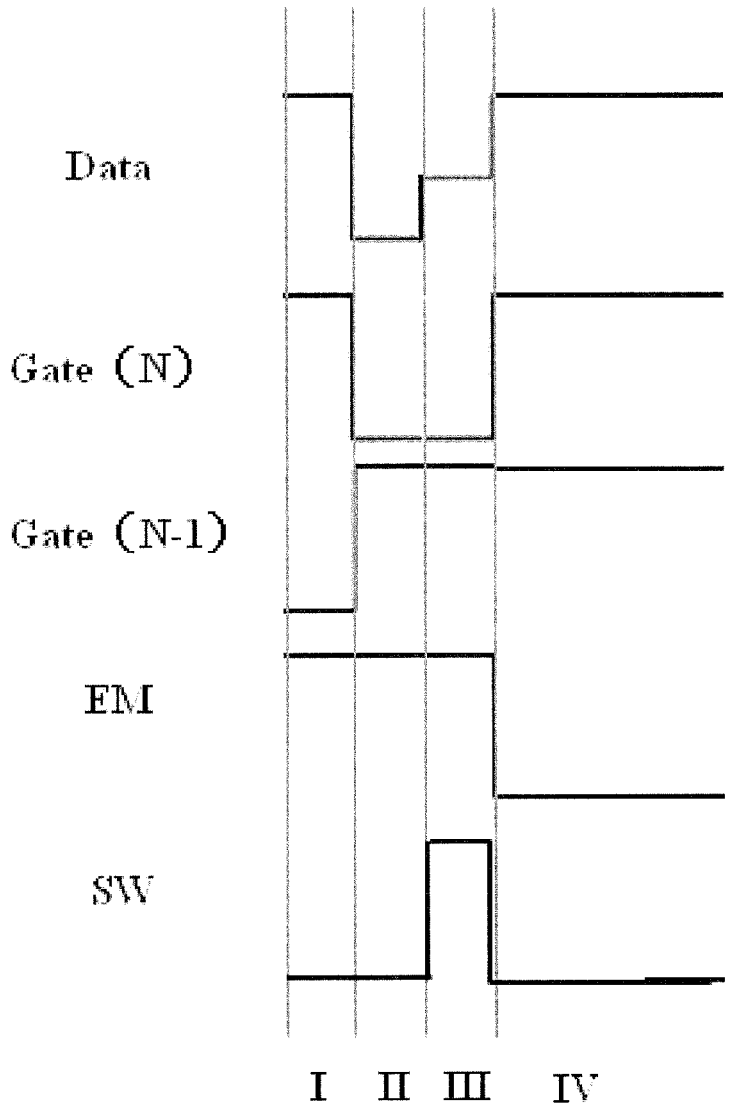
FIG. 4 is a timing chart of operation of the 11T2C AMOLED pixel circuit provided by the embodiment of the present invention.
Figure 5:
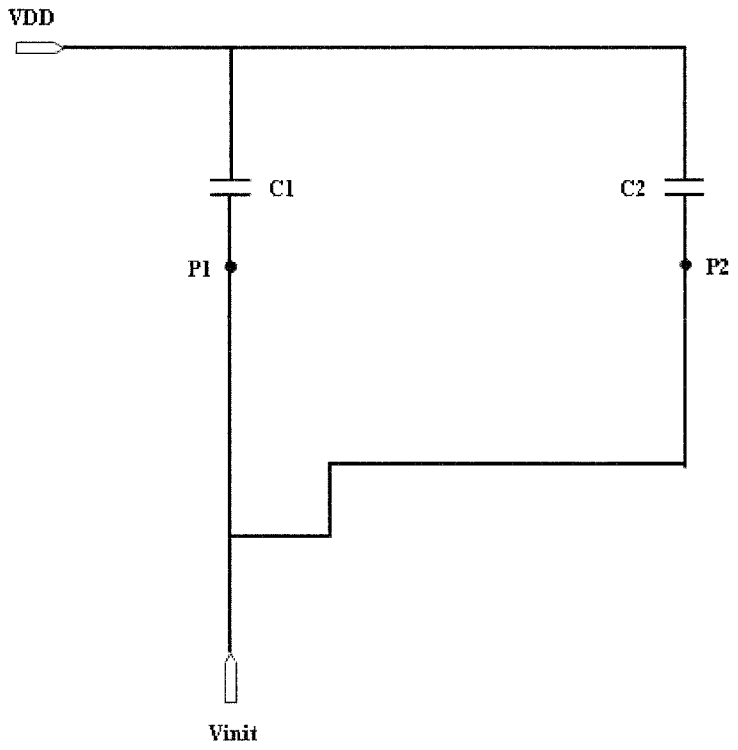
FIG. 5 is a simplified circuit diagram of the 11T2C AMOLED pixel circuit provided by the embodiment of the present invention at initialization operation phase.

As shown in FIG. 4, during phase I, the gate control signal Gate(N) at the present stage and the light emission control signal EM are at the high level; the gate control signal Gate(N−1) at the previous stage and the switching control signal SW are at the low level; at this timing, the first transistor T1, the fifth transistor T5 and the eleventh transistor T11 in FIG. 3 are turned on; the second transistor T2, the third transistor T3, the sixth transistor T6, the seventh transistor T7, the eighth transistor T8 and the tenth transistor T10 are turned off; therefore, the simplified circuit diagram of FIG. 3 is shown in FIG. 5. Since storage capacitors C1 and C2 store the data signal Data inputted from a previous frame picture respectively, both of the two capacitors are connected to the initialization voltage level signal Vinit with the low potential, and each of the storage capacitors C1 and C2 discharges the initialization voltage level signal Vinit so that it is discharged to the initialization voltage $V_{init}$.

Figure 6:
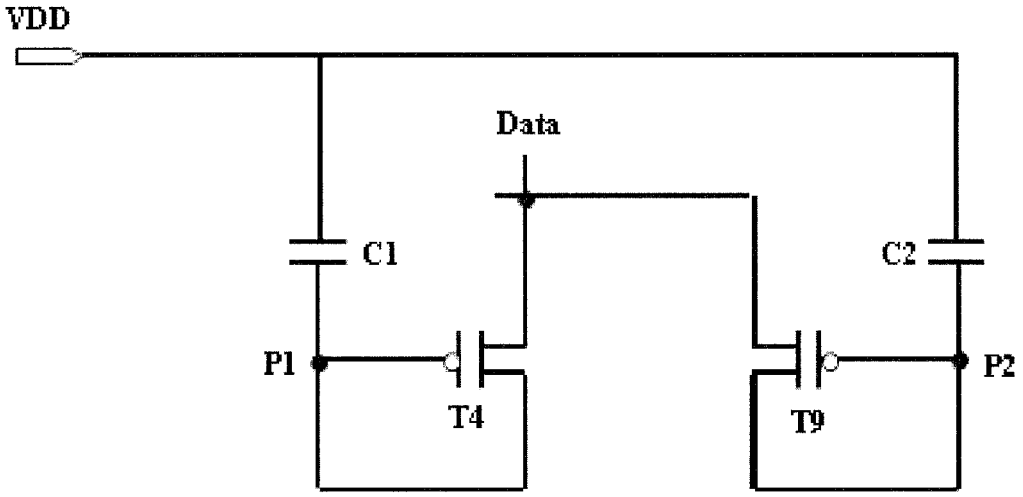
FIG. 6 is a simplified circuit diagram of the 11T2C AMOLED pixel circuit provided by the embodiment of the present invention at a first threshold compensation phase.

As shown in FIG. 4, during phase II, the gate control signal Gate(N−1) at the previous stage and the light emission control signal EM are at the high level; the gate control signal Gate(N) at the present stage and the switching control signal SW are at the low level; at this timing, the second transistor T2, the third transistor T3, the fifth transistor T5 and the tenth transistor T10 in FIG. 3 are turned on; the first transistor T1, the sixth transistor T6, the seventh transistor T7, the eighth transistor T8 and the eleventh transistor T11 are turned off; therefore, the simplified circuit diagram of FIG. 3 is shown in FIG. 6. The data level signal Data has a first voltage value V1, and at this timing, the fourth transistor T4 is equivalent to a diode and the voltage of a first node P1 becomes a value of V=V1−Vth (T4), where Vth (T4) is the threshold voltage of the fourth transistor T4, and the voltage value V is stored in the storage capacitor C1; the ninth transistor T9 is equivalent to a diode and the voltage of a second node P2 becomes a value of V'=V1−Vth (T9), where Vth (T9) is the threshold voltage of the ninth transistor T9, and the voltage value V' is stored in the storage capacitor C2 and the two capacitors C1 and C2 are charged simultaneously.

Figure 7:
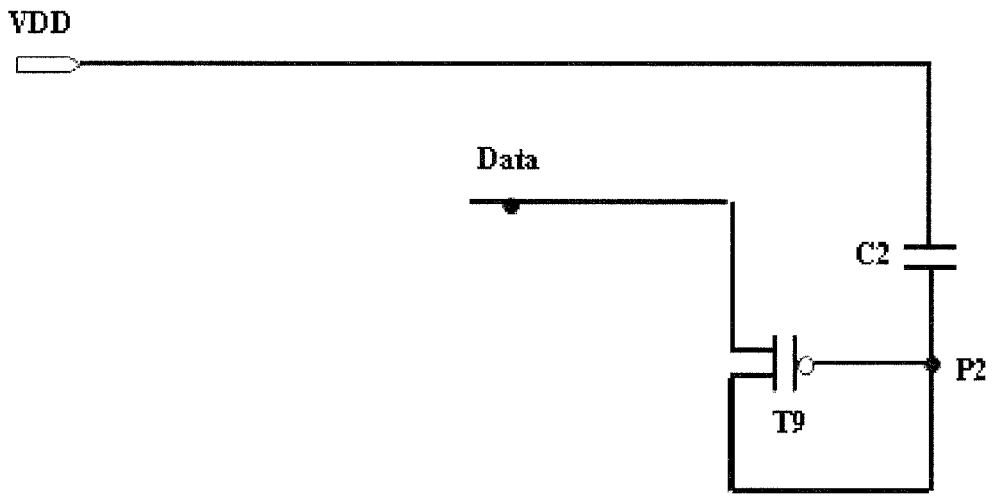
FIG. 7 is a simplified circuit diagram of the 11T2C AMOLED pixel circuit provided by the embodiment of the present invention at a second threshold compensation phase.

As shown in FIG. 4, during phase III, the gate control signal Gate(N−1) at the previous stage, the switching control signal SW and the light emission control signal EM are at high level; the gate control signal Gate(N) at the present stage is at the low level; at this timing, the second transistor T2, the third transistor T3 and the tenth transistor T10 in FIG. 3 are turned on; the first transistor T1, the eleventh transistor T11, the fifth transistor T5, the seventh transistor T7, the eighth transistor T8 and the sixth transistor T6 are turned off; therefore, the simplified circuit diagram of FIG. 3 is shown in FIG. 7. The data level signal Data has the second voltage value V2, and at this timing, the ninth transistor T9 is equivalent to a diode and the voltage of the second node P2 becomes of a value of V"=V2−Vth (T9), where Vth (T9) is the threshold voltage of the ninth transistor T9, and the voltage value V" is stored in the storage capacitor C2.

Figure 8:
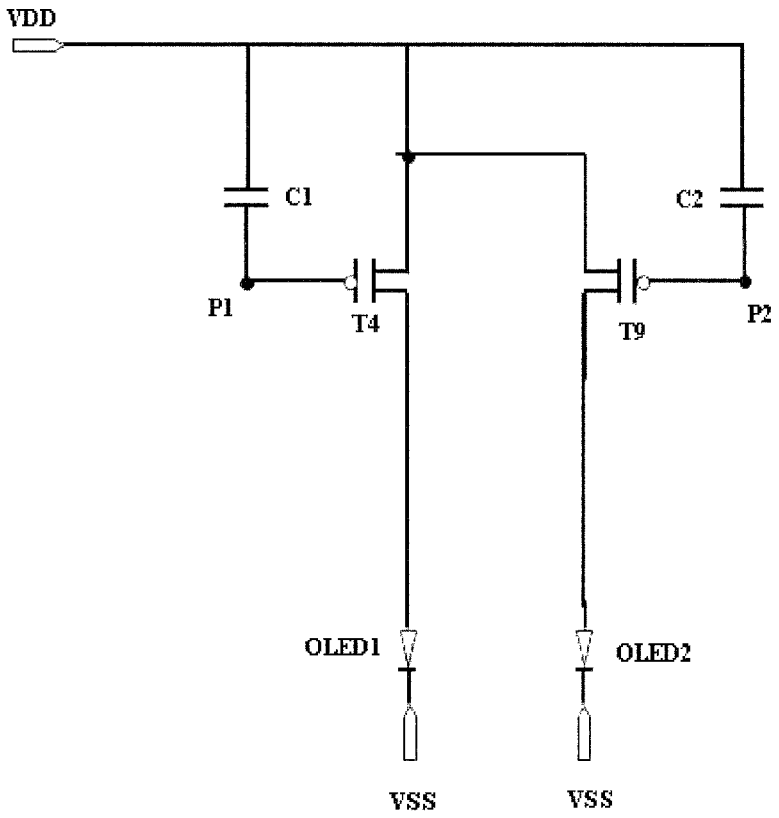
FIG. 8 is a simplified circuit diagram of the 11T2C AMOLED pixel circuit provided by the embodiment of the present invention at a light emission phase.

As shown in FIG. 4, in phase IV which is the light emission phase, the gate control signal Gate(N−1) at the previous stage and the gate control signal Gate(N) at the present stage are at the high level; the light emission control signal EM and the switching control signal SW are at the low level; at this timing, the fifth transistor T5, the sixth transistor T6, the seventh transistor T7 and the eighth transistor T8 in FIG. 3 are turned on; the first transistor T1, the second transistor T2, the third transistor T3, the tenth transistor T10 and the eleventh transistor T11 are turned off; therefore, the simplified circuit diagram of FIG. 3 is shown in FIG. 8. Each of the fourth transistor T4 and the ninth transistor T9 is a driving transistor of OLED, and controls the current in such a way that the sources of the fourth transistor T4 and the ninth transistor T9 are connected to the high voltage level signal VDD, where the numerical value of the voltage of the high voltage level signal VDD is a constant value, and the current flowing through the first light-emitting diode OLED1 is expressed by:

$$Id1 = \frac{k}{2} * [VDD - (V1 - Vth(T4)) - Vth(T4)]^2 = \frac{k}{2} * (VDD - V1)^2,$$

Where, k is a preset constant, the current flowing through the second light-emitting diode OLED2 is expressed by $$Id2 = \frac{k}{2} * [VDD - (V2 - Vth(T9)) - Vth(T9)]^2 = \frac{k}{2} * [VDD - V2]^2,$$

As can be seen from the above equations, the current Id1 flowing through the first light-emitting diode OLED1 and the current Id2 flowing through the second light-emitting diode OLED2 are independent of the threshold voltage Vth (T4) of the fourth transistor T4 and threshold voltage Vth (T9) of the ninth transistor T9, and therefore can play a role of compensation.

As described above, the AMOLED pixel circuit provided by the embodiments of the present invention comprises eleven thin film transistors and two capacitors, that is, 11T2C AMOLED pixel circuit.

An embodiment of the present invention provides a display comprises a plurality of pixels, data signal lines and gate control signal lines, wherein each two of the pixels constitute a pixel unit, and the display further comprises the 11T2C AMOLED pixel circuit provided by the embodiments of the present invention which is connected to respective one of pixel units.

Hereinafter, an arrangement of the pixel unit comprising two pixels will be described in details.

Figure 9:
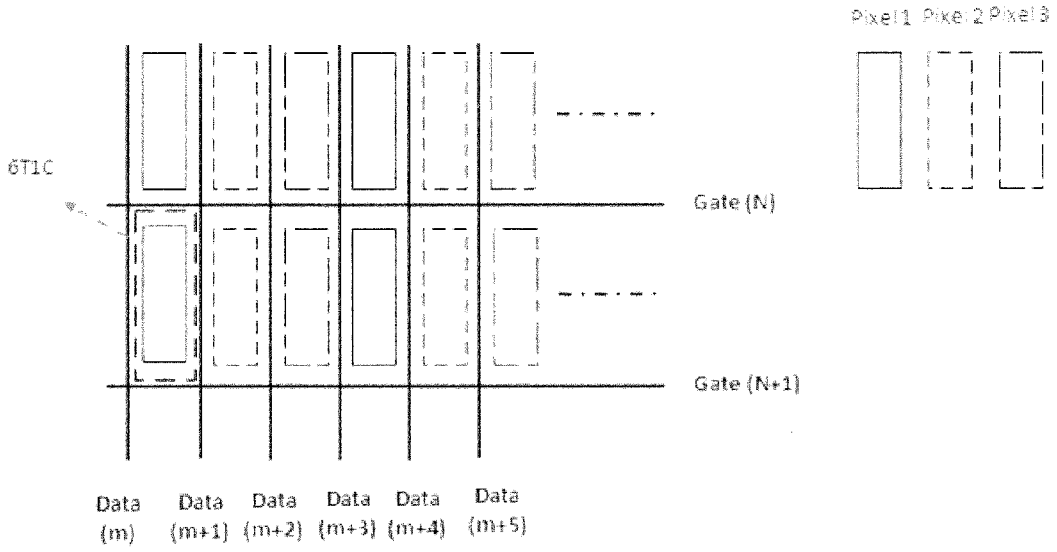
FIG. 9 is a schematic diagram of arrangement of a single pixel as known.

The known pixel arrangement of a single pixel is shown in FIG. 9, and the compensation circuit in the single pixel is the known 6T1C AMOLED pixel compensation circuit; if two pixels are placed together to form one pixel unit, the compensation circuit of the pixel unit is the known 12T2C AMOLED pixel compensation circuit.

The arrangement of the pixel unit comprising two pixels provided by the embodiments of the present invention is shown in FIGS. 10-13, in which two pixels in any of the pixel units arranged in a horizon direction share one data signal line Data(m), and two pixels in any of the pixel units arranged in a vertical direction share one gate control signal line Gate (N), and in which two pixels in any of the pixel units arranged in the horizon direction are any two pixels in the horizon direction such as Pixel 1 and Pixel 2, or Pixel 2 and Pixel 3, and two pixels in any of the pixel units arranged in the vertical direction are any two pixels in the vertical direction.

Figure 10:
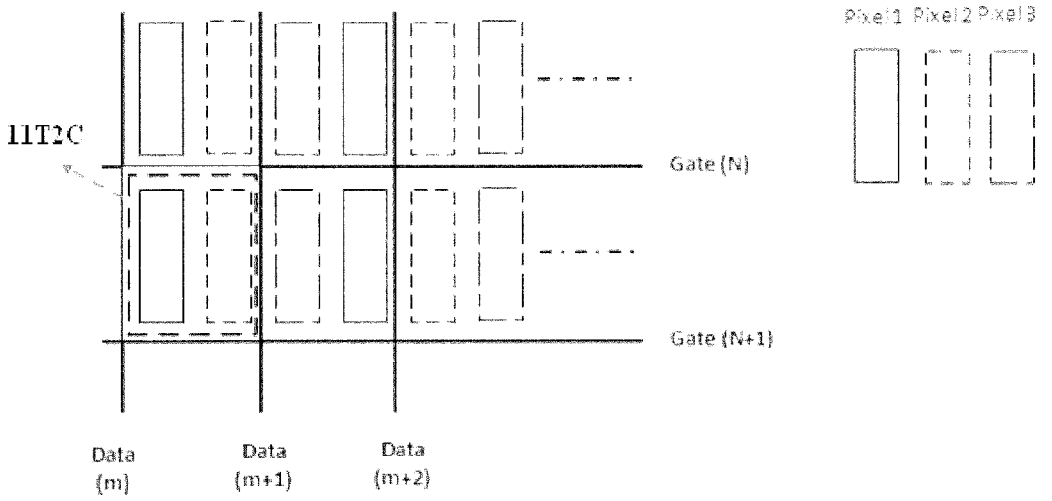
FIG. 10 is a schematic diagram of a horizon arrangement of a pixel unit formed by any two of the pixels provided by the embodiment of the present invention.
Figure 11:
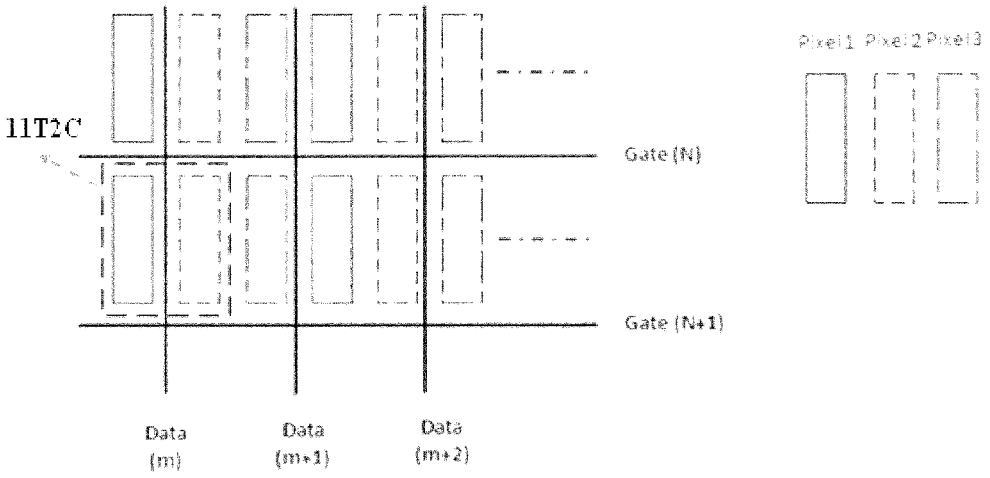
FIG. 11 is a schematic diagram of another horizon arrangement of a pixel unit formed by any two of the pixels provided by the embodiment of the present invention.

As shown in FIGS. 10 and 11, two pixels in any of the pixel units arranged in the horizon direction share one data signal line Data (m), wherein the data signal line Data (m) is positioned between two pixels of Pixel 1 and Pixel 2 arranged in the horizon direction, or the data signal line Data (m) is positioned on a side of Pixel 1 of two pixels of Pixel 1 and Pixel 2 arranged in the horizon direction; of course, in the embodiments of the present invention, the data signal line Data (m) is not limited to be positioned on a side of the Pixel 1, and can be positioned on a side of any one of the two pixels arranged in the horizon direction.

Figure 12:
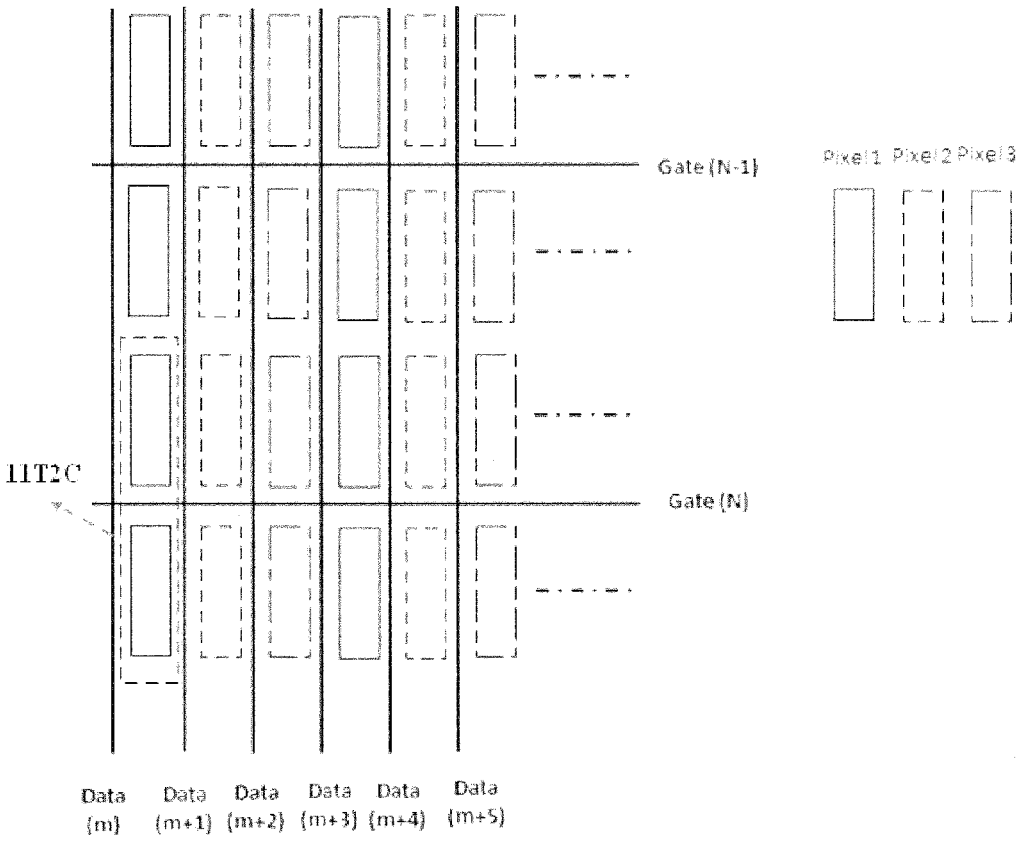
FIG. 12 is a schematic diagram of a vertical arrangement of the pixel unit formed by any two of the pixels provided by the embodiment of the present invention.
Figure 13:
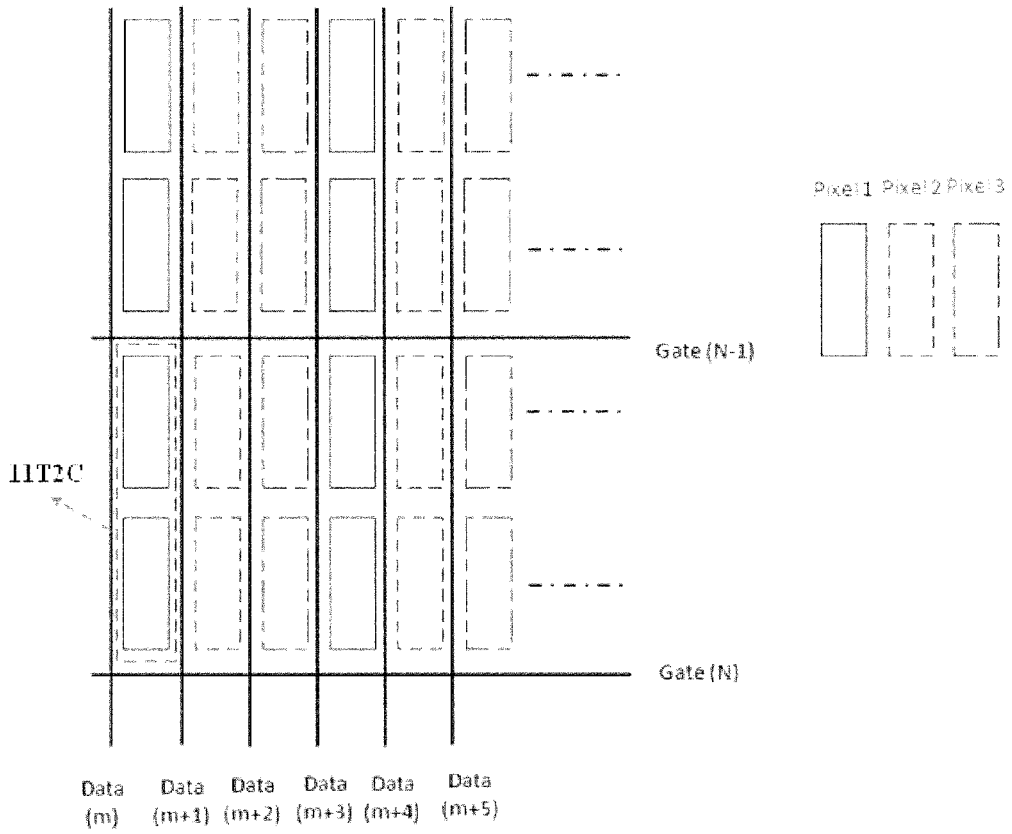
FIG. 13 is a diagram of another vertical arrangement of the pixel unit formed by any two of the pixels provided by the embodiment of the present invention.

As shown in FIGS. 12 and 13, two pixels in any of the pixel units arranged in the vertical direction share one gate control signal line Gate (N), wherein the gate control signal line Gate (N) is positioned between any two of the pixels forming a pixel unit which are arranged in the vertical direction, or the gate control signal line Gate (N) is positioned on a side of any one of any two pixels forming a pixel unit which are arranged in the vertical direction.

In summary, in the technical solution provided by the embodiments of the present invention, the AMOLED pixel circuit comprises a first pixel sub-circuit and a second pixel sub-circuit, as well as an initialization module and a data voltage writing module connected to the first pixel sub-circuit and the second pixel sub-circuit; the initialization module is connected to the reset signal terminal and the low potential terminal, and serves to initialize the first pixel sub-circuit and the second pixel sub-circuit under control of a reset signal inputted from the reset signal terminal; the data voltage writing module is connected to a data voltage and a gate signal terminal, and serves to first write a first data voltage to the first pixel sub-circuit under control of a signal inputted from the gate signal terminal and compensate for a driving module of the first pixel sub-circuit, and then to write a second data voltage to the second pixel sub-circuit and compensate for a driving module of the second pixel sub-circuit; the AMOLED pixel circuit can reduce the size of pixel circuit, so as to further reduce pixel pitch, increase the number of pixels contained in per unit area and improve image display quality.

Obviously, those skilled in the art can make various changes or variations to the embodiments of the present invention without departing from the spirit and scope of the present invention. In this way, as long as those modifications and variations to the embodiments of the present invention are within the scope of the claims of the present invention and the equivalence thereof, the present invention is also intended to cover these changes and variation.

What is claimed is:

1. A pixel circuit comprising a first pixel sub-circuit and a second pixel sub-circuit, as well as an initialization module and a data voltage writing module connected to the first pixel sub-circuit and the second pixel sub-circuit, wherein The first pixel sub-circuit comprises a first driving module and the second pixel sub-circuit comprises a second driving module;

the initialization module is connected to a reset signal terminal and a low potential terminal, and is configured to initialize the first pixel sub-circuit and the second pixel sub-circuit under control of a reset signal inputted from the reset signal terminal;

the data voltage writing module is connected to a data voltage and a gate signal terminal, and is configured to write a first data voltage during a first writing period to the first pixel sub-circuit and the second pixel sub-circuit under control of a signal inputted from the gate signal terminal and compensate for the first driving module of the first pixel sub-circuit, and then to write a second data voltage during a second writing period to the second pixel sub-circuit and compensate for the second driving module of the second pixel sub-circuit;

wherein the initialization module comprises a first transistor configured to initialize the first pixel sub-circuit;

the data voltage writing module comprises a second transistor, wherein a gate of the second transistor is connected to the gate signal terminal, a source of the second transistor is connected to a data signal line, and a drain of the second transistor is connected to the second driving module of the second pixel sub-circuit;

the first threshold compensation module comprises a compensation transistor;

a gate of the compensation transistor is connected to a switching control signal line, a source of the compensation transistor is connected to the drain of the second transistor, and a drain of the compensation transistor is connected to the first driving module of the first pixel sub-circuit, wherein the compensation transistor is turned off during the second writing period so that the second data voltage is not written to the first driving module of the first pixel sub-circuit.

2. The pixel circuit according to claim 1, wherein the first pixel sub-circuit further comprises a first light emission module, a first threshold compensation module and a first light emission control module, wherein the initialization module is connected to the first threshold compensation module, and is configured to initialize the first threshold compensation module under control of an initialization signal outputted from the initialization module;

the first threshold compensation module is connected to the first driving module, and is configured to perform threshold voltage compensation on the first driving module; and the first light emission module is connected to the first light emission control module, and is configured to emit light for display under control of the first light emission control module.

3. The pixel circuit according to claim 2, wherein the second pixel sub-circuit further comprises a second light emission module, a second threshold compensation module and a second light emission control module, wherein the initialization module is connected to the second threshold compensation module, and is configured to initialize the second threshold compensation module under control of an initialization signal outputted from the initialization module;

the second threshold compensation module is connected to the second driving module, and is configured to perform threshold voltage compensation on the second driving module; and the second light emission module is connected to the second light emission control module, and is configured to emit light for display under control of the second light emission control module.

4. The pixel circuit according to claim 2, wherein, the first threshold compensation module further comprises a first storage capacitor, and a third transistor;

the first driving module comprises a fourth transistor;

the first light emission control module comprises a sixth transistor and a seventh transistor; and the first light emission module comprises a first light-emitting diode.

5. The pixel circuit according to claim 4, wherein one terminal of the first storage capacitor is connected to a high voltage level signal line, and the other terminal thereof is connected to a source of the third transistor;

a gate of the third transistor is connected to a gate signal terminal, and a drain of third transistor is connected to a drain of the fourth transistor;

a gate of the fourth transistor is connected to the initialization module;

a gate of the sixth transistor is connected to the light emission control signal line, and a source of the sixth transistor is connected to the high voltage level signal line;

a gate of the seventh transistor is connected to the light emission control signal line, a source of the seventh transistor is connected to a drain of the fourth transistor, and a drain of the seventh transistor is connected the first light-emitting diode; and an anode of the first light-emitting diode is connected is the drain of the seventh transistor, and a cathode of the first light-emitting diode is connected to a low voltage level signal line.

6. The pixel circuit according to claim 3, wherein, the second threshold compensation module comprises a second storage capacitor and a tenth transistor;

the second driving module comprises a ninth transistor;

the second light emission control module comprises a sixth transistor and an eighth transistor; and the second light emission module comprises a second light-emitting diode.

7. The pixel circuit according to claim 6, wherein, one terminal of the second storage capacitor is connected to the high voltage level signal line, and the other terminal thereof is connected to a source of the tenth transistor;

a gate of the tenth transistor is connected to the gate signal terminal, and a drain of the tenth transistor is connected to a drain of the ninth transistor;

a gate of the ninth transistor is connected to the source of the tenth transistor, and a source of the ninth transistor is connected to the data voltage writing module;

a gate of the sixth transistor is connected to the light emission control signal line, and a source of the sixth transistor is connected to the high voltage level signal line, and a drain of the sixth transistor is connected to the source of the ninth transistor;

a gate of the eighth transistor is connected to the light emission control signal line, and a source of the eighth transistor is connected to the drain of the ninth transistor, and a drain of the eighth transistor is connected to the second light-emitting diode; and an anode of the second light-emitting diode is connected to the drain of the eighth transistor, and a cathode of the second light-emitting diode is connected to the low voltage level signal line.

8. The pixel circuit according to claim 3, wherein, the initialization module further comprises an eleventh transistor configured to initialize the second pixel sub-circuit, wherein a gate of the first transistor is connected to a reset signal line, a drain of the first transistor is connected to the first threshold compensation module of the first pixel sub-circuit, and a source of the first transistor is connected to a low potential terminal;

a gate of the eleventh transistor is connected to the reset signal line, a drain of the eleventh transistor is connected to the second threshold compensation module of the second pixel sub-circuit, and a source of the eleventh transistor is connected to the low potential terminal.

9. The pixel circuit according to claim 1, wherein data voltages written by the data voltage writing module comprises a first data voltage and a second data voltage, wherein the first data voltage is configured to drive the first threshold compensation module to perform the threshold voltage compensation on the first driving module, and the second data voltage is configured to drive the second threshold compensation module to perform the threshold voltage compensation on the second driving module.

10. The pixel circuit according to claim 4, wherein the first light-emitting diode is an organic light-emitting diode.

11. The pixel circuit according to claim 4, wherein each of the transistors is a thin film transistor of P type.

12. A display comprising a plurality of pixels, data signal lines and gate control signal lines, characterized in that, each two of the pixels constitute a pixel unit, and the display further comprises the pixel circuit according to claim 1 which is connected to respective one of pixel units.

13. The display according to claim 12, wherein, the two pixels in each of the pixel units share one data signal line.

14. The display according to claim 12, wherein, the two pixels in each of the pixel units share one gate control signal line.

15. The pixel circuit according to claims 6, wherein the second light-emitting diode is an organic light-emitting diode.

16. The display according to claim 12, wherein the first pixel sub-circuit further comprises a first light emission module, a first threshold compensation module and a first light emission control module, wherein the initialization module is connected to the first threshold compensation module, and is configured to initialize the first threshold compensation module under control of an initialization signal outputted from the initialization module;

the first threshold compensation module is connected to the first driving module, and is configured to perform threshold voltage compensation on the first driving module; and the first light emission module is connected to the first light emission control module, and is configured to emit light for display under control of the first light emission control module.

17. The display according to claim 16, wherein the second pixel sub-circuit further comprises a second light emission module, a second threshold compensation module and a second light emission control module, wherein the initialization module is connected to the second threshold compensation module, and is configured to initialize the second threshold compensation module under control of an initialization signal outputted from the initialization module;

the second threshold compensation module is connected to the second driving module, and is configured to perform threshold voltage compensation on the second driving module; and the second light emission module is connected to the second light emission control module, and is configured to emit light for display under control of the second light emission control module.

18. The display according to claim 16, characterized in that, the first threshold compensation module further comprises a first storage capacitor, and a third transistor;

the first driving module comprises a fourth transistor;

the first light emission control module comprises a sixth transistor and a seventh transistor; and the first light emission module comprises a first light-emitting diode.

19. The display according to claim 17, wherein, the second threshold compensation module comprises a second storage capacitor and a tenth transistor;

the second driving module comprises a ninth transistor;

the second light emission control module comprises a sixth transistor and an eighth transistor; and the second light emission module comprises a second light-emitting diode.

* * * * *